US005352006A

United States Patent [19]

Ocuin

[11] Patent Number: 5,352,006

[45] Date of Patent: Oct. 4, 1994

[54] HANGING ASSEMBLY FOR FOLDING GARMENT BAGS

[76] Inventor: Morton Ocuin, 2736 Independence Ave., Bronx, N.Y. 10463

[21] Appl. No.: 981,554

[22] Filed: Nov. 25, 1992

[51] Int. Cl.[5] ..... A45C 13/26

[52] U.S. Cl. ..... 294/142; 206/289; 294/167

[58] Field of Search ..... 294/26, 137, 141–143, 294/148, 149, 151, 153, 167–199; 16/110 R, 115; 150/107, 108; 190/111, 112, 115, 117, 119; 206/278, 279, 284, 286, 287, 287.1, 293; 248/339, 690–693; 383/6, 22–25

[56] References Cited

U.S. PATENT DOCUMENTS

| | | | |
|---|---|---|---|
| 2,009,192 | 7/1935 | Freysinger | 16/115 X |
| 2,689,631 | 9/1954 | Marks | 206/287.1 X |
| 3,198,300 | 8/1965 | Tuttle | 16/115 |
| 3,958,675 | 5/1976 | Rosenblum | 206/287.1 |
| 4,342,479 | 8/1982 | Hofer | 294/142 |
| 4,508,202 | 4/1985 | Siegert et al. | 16/115 X |
| 4,838,396 | 6/1989 | Krenzel | 190/115 X |
| 4,887,700 | 12/1989 | Rice | 206/287.1 X |
| 4,927,014 | 5/1990 | Pulichino | 206/287.1 |
| 5,064,061 | 11/1991 | Moxley | 206/289 |

*Primary Examiner*—Johnny D. Cherry
*Attorney, Agent, or Firm*—Robert W. Fiddler

[57] ABSTRACT

A hanging assembly for securement to a free end of a folding garment bag to facilitate hanging of the garment bag over a door or closet pole. The hanging assembly is formed with a base plate securable to the end of the garment bag forming the top of the bag when the bag is extended for hanging. A chain guide is formed on the base plate and an elongate chain is trained over this guide. One end of the chain is coupled to one end of an elongatable coil spring, the other end of which is anchored to the base plate. The other end of the chain is coupled to a hook/handle member. The hook/handle member is formed of a wire shaped with an open reverse bent end forming a hook, and a closed reverse bent end forming a handle. The base plate is provided with a hook retaining pocket for receiving and enclosing the hook when the hook/handle is in a retracted position, and a handle engaging finger for gripping the handle when not in use. The chain is formed of a plurality of spaced balls interconnected by pins and a chain guiding and anchoring flange is formed integral with a metal reinforcing plate secured to the base plate. A screw extending through the metal reinforcing plate into the bag permits formation of the base plate of plastic while providing sufficient strength in the interconnection between the chain and the bag to provide desired support for the bag when hanging.

12 Claims, 1 Drawing Sheet

HANGING ASSEMBLY FOR FOLDING GARMENT BAGS

This invention relates to the art of luggage handles, and more particularly a combined hanging hook and handle for use in connection with a foldable garment bag of the type employed by travelers to carry garments such as dresses and suits which it is not deemed desirable to fold into a suitcase.

BACKGROUND OF THE INVENTION

Foldable garment bags are formed with a handle and/or shoulder strap arranged midway along the length of the bag which is folded over to expose the handle and shoulder strap so that the garment bag may be carried folded over on itself to approximate a suitcase size. When the traveler is on a plane, bus or train, or arrives in a hotel room, the garment bag halves are unfolded, and the garment bag is hung on a closet rod or on a door by means of a hanger extending from the top free end of the bag.

When garment bags of this type are folded for carrying, the hanger by which the garment bag is hung often dangles from the bag, becoming entangled with adjacent objects as the bag is moved.

Further, problems arise in manipulating the hanger by which the bag is to be hung to position it over a rod or door top due to the difficulty of gripping the hanger and keeping a user's fingers from being squeezed between the hanger and rod, or door top.

In order to obviate the problems existing with a free hanging garment bag hanger, a variety of arrangements have been evolved to enclose the free end of the hanger when the hanger is not being actively employed.

Thus in U.S. Pat. No. 3,958,675, the supporting hanger is coupled to the bag by a chain which may be retracted with the hanger into the garment bag. In U.S. Pat. No. 4,342,479 a hanger assembly is disclosed in which the hanger is subject to being engaged by a clip or by means of a hook and loop type fastener when not in use. In U.S. Pat. No. 4,887,700, the hanger is subject to being engaged in a loop on the other end of the bag and hidden under a flap. In U.S. Pat. No. 4,927,014, the bag hanger is subject to being hidden under a retainer flap formed in the opposite end of the bag when the bag is folded. In U.S. Pat. No. 4,064,061, a hanger assembly is disclosed in which the hanger is spring-retractable so that the free end engages in a grommet on the carrying case body.

These prior art patents broadly serve to solve the problem of permitting the hanger to be protected when not in use. However, problems exist in the use of these prior art devices in that special manipulation of the hanger is required, and/or the hanger is not readily manipulable into position over a closet rod or door top.

SUMMARY OF THE INVENTION

It is with the above considerations in mind that the present improved hanger assembly has been evolved in which the hanger is formed with a handle element facilitating manipulation of the hanger and carrying of the bag in an extended unfolded position and in which the hanger is biased to a retracted protected position.

It is accordingly among the primary objects of this invention to provide an improved hanging assembly for foldable garment bags of the type used by travelers.

Another object of the invention is to provide a hanging assembly in which the hook-handle elements of the assembly may readily be retracted to a protected and inoperative position when not in use.

A further object of the invention is to provide a hanging assembly for travelers' garment bags in which a handle is provided to facilitate manipulation of the hanger and the bag.

These and other objects of the invention which will become hereafter apparent are achieved by forming a hanging assembly for securement to the end of a folding garment bag which will be the upper end of the bag when it is extended for hanging. The hanging element is formed of a base plate securable to the end of the bag and a hook-handle assembly is extensibly secured to the base plate by means of a connected elongate chain and coil spring with the spring end remote from the chain fixed with respect to the base plate, and the chain trained to pass over a chain guide through a chain guiding opening in a flange on said plate. A hook-handle member is coupled to the free end of the chain so that the hook-handle member may be gripped by means of the handle, extended from the bag and hung over a door or closet pole to support the bag. The plate is formed with a hook pocketing chamber and a handle engaging finger for engaging the hook-handle member when not in use and retracted by the action of the spring.

A feature of the invention resides in the formation of the chain of a plurality of spaced balls interconnected by pins, and the opening in the chain guiding flange provided width a knife edge to engage a pin between the balls of the chain so as to permit locking of the chain at a desired extended position.

Another feature of the invention resides in the use of a metal reinforcing plate to form the flange with a fastening member such as a screw extending through the plate into the bag top to effect securement of the assembly to the bag thereby insuring a connection between the chain and the bag independent of the base plate permitting the base plate to be molded of plastic, reducing production costs.

BRIEF DESCRIPTIONS OF THE DRAWINGS

The specific details of a preferred embodiment of the invention will be described in clear, concise and exact terms setting forth the best mode contemplated by applicant so as to enable any person skilled in the art to practice the invention in conjunction with the following drawings, wherein.

DESCRIPTION OF PREFERRED EMBODIMENT

Figure 1:
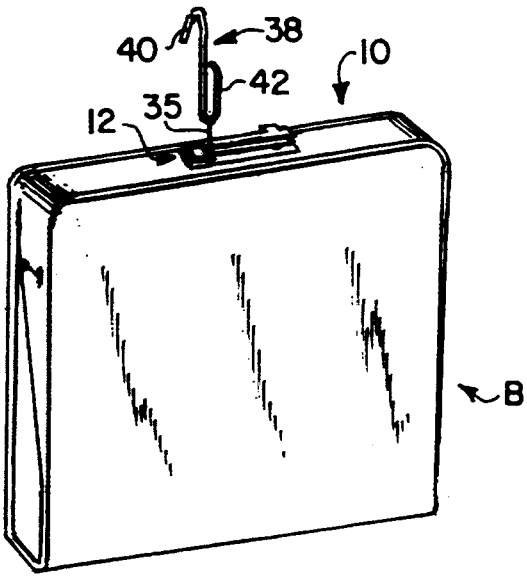
FIG. 1 is a perspective view of a garment bag having a hanging assembly made in accordance with the invention, shown in position to hang the bag over a door or from a closet pole.
Figure 2:
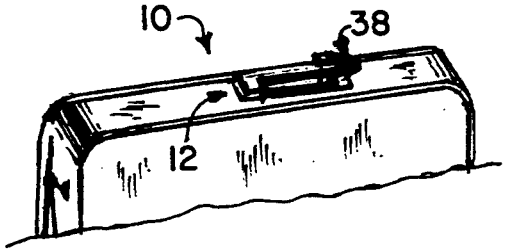
FIG. 2 is a perspective view of the top of the bag shown in FIG. 1 with the hook-handle member of the assembly shown in a storage position.

Referring now more particularly to the drawings where like numerals will be employed to designate like parts, as best seen in FIGS. 1 and 2, a hanging assembly 10 is provided for securement to what will be the upper end of a foldable garment bag B when it is unfolded for hanging over a door or closet.

Figure 6:
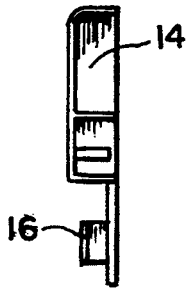
FIG. 6 is a right end view of the base plate of the hanging assembly.
Figure 3:
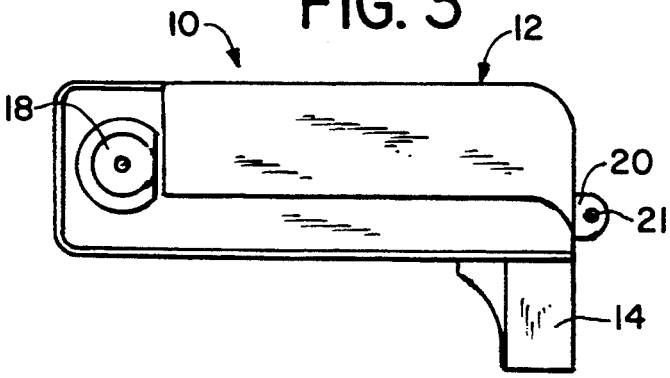
FIG. 3 is a bottom plan view of the hanging assembly base plate showing the chain guide.
Figure 4:
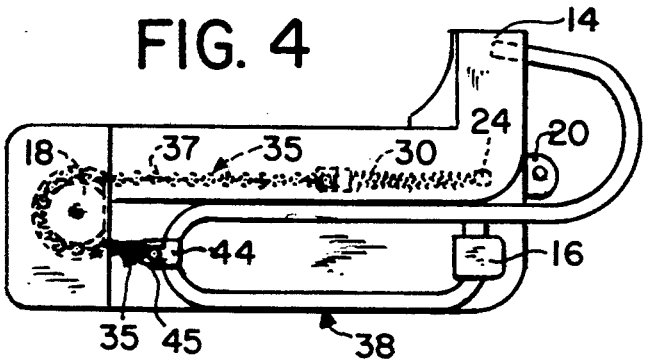
FIG. 4 is a top plan view of the base plate showing the hook-handle member in a storage position with the spring and chain shown in phantom, with the path of the chain shown trained over the chain guide.

This hanging assembly 10 is formed with a base plate 12, as best seen in FIGS. 1–5. Base plate 12 lends itself to ready formation of a variety of plastics by molding or the like. A hook retaining pocket 14 (as best seen in FIGS. 3, 4 and 6) is molded into one end of the base plate 12 (to the right as viewed in FIGS. 3 and 4), and a handle engaging finger 16 is similarly formed on the base plate. A chain guide 18 in the form of an arcuately extending ridge (as seen to the left in FIGS. 3 and 4); is molded on the end of the plate remote from pocket 14 and hook 16. Tab 20 having screw passing opening 21 for a plate anchoring screw is provided at the end of the plate remote from the chain guide 18.

Figure 7:
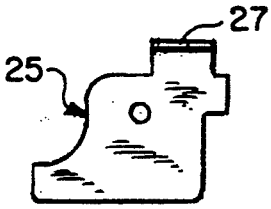
FIG. 7 is a top plan view of the metal reinforcing plate.
Figure 8:
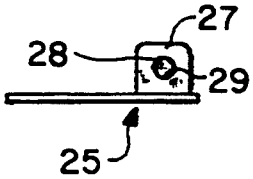
FIG. 8 is a front elevational view of the metal reinforcing plate shown in FIG. 7.
Figure 5:
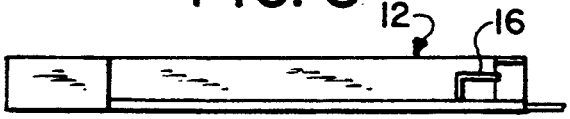
FIG. 5 is a front elevational view of the base plate as seen in FIGS. 3 and 4.

A reinforcing plate 25, preferably of metal, contoured as best seen in FIGS. 7 and 8 is provided for positioning with respect to base plate 12. A chain guiding flange 27 is formed to extend perpendicular to the plane of the metal plate 25 through an opening in base plate 12, and a chain guiding opening 28 is formed in flange 27. A knife edge 29 is formed on a rim of the opening 28.

An elongate coil spring 30 has one end attached to spring anchoring screw 24 which extends through an opening in the plate 12. Anchoring screw 24 is selected of a length such as to extend beyond the bottom surface of base plate 12 through the top wall of the garment bag to aid in affixing base plate 12 to the garment bag. The other end of spring 30 is affixed to one end of an elongate chain 35 as best seen in FIG. 4 formed of spaced balls 37 interconnected by pins 36. The chain 35 is threaded around chain guide 18 through chain guiding opening 28 in flange 27. As will be apparent to those skilled in the art, the thickness of flange 27 is such as to permit the flange to lie between the spaced balls 37 against chain pins 36.

A hook-handle member 38 as best seen in FIG. 4 is secured to the end of the elongate chain 35 remote from spring 30. Hook-handle member 38 is formed of a wire having one end reverse bent on itself to leave an open hook end 40, as seen in FIG. 1 and a closed reverse bent end forming a handle end 42. The handle end 42 is provided with a clip 44 having spaced prongs 45 engaging a ball of the chain 35.

OPERATION

The aforedescribed hanging assembly is formed employing conventional production techniques for the molding of plastics and the shaping of metals, and the subsequent combination of these formed elements. The base plate 12, though subject to being formed of a variety of materials, is in accordance with the preferred embodiment formed by molding a plastic into the illustrated and described contours of the base plate. The metal plate 25 is formed employing conventional metal stamping and bending techniques into the illustrated contour. The coil spring 30 and ball and pin chain 35 are conventional off the shelf items. The hook-handle member 38 is formed of wire of a suitable gauge employing conventional wire bending techniques. The end of the closed handle 42 is preferably welded, and the chain engaging clip 44 on the end of the handle is preferably welded thereto. One end of the chain is secured to the clip 44 on the handle 42 by permitting the prongs 45 on the clip to engage preferably the last ball on the chain 35 and the other end of the chain 35 is secured to a spring 30 anchored to the spring anchoring screw 24.

The assembled components are then secured to the end of a foldable garment bag, which will be the upper end of the bag when the bag is unfolded for hanging, by extending an anchoring screw through the base plate into the garment bag where the free end of the screw is preferably engaged by a nut and/or threaded plate in the bag. An additional fastening screw or screws may similarly be extended through base plate 12 into the bag.

Thereafter, as is apparent to those skilled in the art, when the bag is folded for carrying, the hook-handle member 38 is retracted against the base plate, with the hook arranged in pocket 14, and the handle held beneath clip 16 so that the hook is not subject to being entangled as the bag is carried. Retraction of the hook-handle member is effected by the contraction of coil spring 30 drawing chain 35 to pull the hook-handle member to the above described retracted position as best seen in FIGS. 2 and 6.

When it is desired to hang the bag to which the hanging assembly is secured, the handle 42 is gripped and moved to free it from clip 16 and the handle is moved to release the hook end 40 of the hook-handle member. Thereafter, the hook-handle member is brought to the position shown in FIG. 1 with the user's hand engaging handle 42 and hook end 40 moved into engagement over the top of a door or closet pole from which it is desired to hang the bag.

The above disclosure has been given by way of illustration and not by way of limitation and it is desired to protect all embodiments of the herein disclosed inventive concept within the scope of the appended claims.

What is claimed is:

1. A hanging assembly for securement to an end of a folding garment bag, to facilitate hanging the bag over a door or closet pole, said assembly comprising:
   - a base plate securable to the end of the garment bag forming the top of the bag when the bag is extended for hanging;
   - a chain guide on said base plate;
   - a spring anchor on said base plate at a point spaced from said chain guide;
   - an elongate extensible coil spring having two ends, one of which is coupled to said spring anchor;
   - an elongate chain having two ends, one of which is coupled to the other end of said spring;
   - a hook-handle member secured to the other end of said chain, said hook-handle member having a hook portion dimensioned to fit over the top of a door or closet pole, and a handle portion dimensioned to accommodate the hand of a user;
   - and a hook retaining pocket on said base plate for receiving and enclosing the hook portion of said hook-handle member when said spring is not extended.

2. A hanging assembly as in claim 1 in which said chain guide comprises an arcuately extending ridge on said base plate.

3. A hanging assembly as in claim 2 in which a metal reinforcing plate is secured to said base plate which is formed of a moldable plastic, and said chain is engaged with said reinforcing plate which is in turn coupled to the bag to be supported.

4. A hanging assembly as in claim 3 in which a chain guiding flange is formed on said metal reinforcing plate.

5. A hanging assembly as in claim 3 in which a screw is extended through said metal plate into the bag with said screw engaging the hag.

6. A hanging assembly as in claim 1 in which said spring anchor comprises a screw member extending through said base plate a distance such as to permit said screw member to extend into engagement with the garment bag in connection with which said assembly is employed.

7. A hanging assembly as in claim 1 in which said hook-handle member is formed from an elongate wire bent with an open reverse bent end forming a hook, and a closed reverse bent end forming a handle.

8. A hanging assembly as in claim 1 in which said hook retaining pocket comprises a compartment in said base plate.

9. A hanging assembly as in claim 1 in which a handle engaging finger is formed on said base plate engaging the handle portion of said hook-handle member when said hook-handle member is retracted by said spring.

10. A hanging assembly as in claim 1 in which the chain is formed of a plurality of spaced balls interconnected by pins.

11. A hanging assembly as in claim 10 in which a reinforcing plate is secured to said base plate and a chain guiding flange is supported by said reinforcing plate, said flange having an opening therethrough dimensioned to permit the free passage through said opening of the balls of said chain and a knife edge on said flange opening selectively engageable against a pin between a pair of the balls of said chain to retain the chain at a desired degree of extension with respect to the base plate.

12. A hanging assembly as in claim 1 in which said base plate is formed with a chain guiding flange having an opening through which said chain extends, said opening serving to guide the movement of said chain.

* * * * *